US005748178A

United States Patent [19]

Drewry

[11] Patent Number: 5,748,178

[45] Date of Patent: May 5, 1998

[54] DIGITAL VIDEO SYSTEM AND METHODS FOR EFFICIENT RENDERING OF SUPERIMPOSED VECTOR GRAPHICS

[75] Inventor: Raymond Drewry, Menlo Park, Calif.

[73] Assignee: Sybase, Inc., Emeryville, Calif.

[21] Appl. No.: 503,757

[22] Filed: Jul. 18, 1995

[51] Int. Cl.[6] ..... G09G 5/36

[52] U.S. Cl. ..... 345/138; 345/136; 345/137; 345/509; 395/109

[58] Field of Search ..... 345/136, 137, 345/138, 509, 515, 197; 395/109; 358/447

[56] References Cited

U.S. PATENT DOCUMENTS

| | | | |
|---|---|---|---|
| 5,005,011 | 4/1991 | Perlman et al. | 345/137 |
| 5,014,129 | 5/1991 | Imanishi | 345/138 |
| 5,264,838 | 11/1993 | Johnson et al. | 345/138 |
| 5,596,684 | 1/1997 | Ogletree et al. | 345/136 |

FOREIGN PATENT DOCUMENTS 15843 10/1991 WIPO .

*Primary Examiner*—Richard Hjerpe
*Assistant Examiner*—Kent Chang
*Attorney, Agent, or Firm*—John A. Smart

[57] ABSTRACT

Video system and methods are described for improved image processing (e.g., anti-aliasing) of digital images. The video system includes a shift register component interposed (operably) between video memory and video digital-to-analog components. In this fashion, the shift register stores, at any given time, a collection of pixel values which have been scanned (read) out of the video memory. The shift register is adapted so that a neighborhood of pixel values is available at a given instance for a current pixel from the image stored in the video memory. Selected cells of the shift register are adapted to include "taps" which form connections between those cells and the input to a multiplier/adder circuit. Once a given neighborhood of pixel values is supplied to the multiplier/adder circuit, the system may compute a new (i.e., enhanced) pixel value by applying a filter template—a collection of filter weightings or coefficients. This is done for each pixel in the image (or image pair) in parallel with the scan out of video memory.

44 Claims, 10 Drawing Sheets

DIGITAL VIDEO SYSTEM AND METHODS FOR EFFICIENT RENDERING OF SUPERIMPOSED VECTOR GRAPHICS

COPYRIGHT NOTICE

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

The present invention relates generally to digital video environments and, more particularly, to systems for rendering vector graphics superimposed on top of rapidly-changing background graphics (e.g., interactive television).

A chronic problem facing designers of computer graphic systems is the artifact of "jaggies"—that is, jagged edges observed by users when viewing vector graphics rendered on a raster device. The jagged edges are a side effect of the block-by-block transformation or "pixelation" which a vector object (e.g., line) undergoes for display as a rasterized computer graphic. For instance, a display monitor, being a raster device, cannot render a line as a continuous vector image. Instead, the line is mapped into those pixels of the display monitor which best approximate the line. FIGS. 1A–B illustrate the pixel-by-pixel approximation used to draw a line. FIG. 1A illustrates a true line 101 which is to be rendered on screen. In FIG. 1B, the line is approximated by a series of square pixels, such as pixel 111. On a computer screen, therefore, the line is translated into discrete pixels which connect the line's endpoints.

Now consider a simple line overlying a rapidly-changing digital video image (e.g., digitized motion picture footage). FIG. 1C, for instance, illustrates an image 120 comprising a line (drawn pixel-by-pixel) superimposed on top of a real image. The real image itself comprises a plurality of true-color pixels, such as the true-color pixel 125. In such a scenario, the human eye perceives the "blockiness" of the pixelated line much more. In other words, the human eye perceives the rendering of the line as being worse, when compared to an identical version of that line which is not superimposed. This is due, to some extent, to the human eye's enhanced ability to detect edges.

The ability of the human eye to detect edges is used to advantage in high-end computer graphic systems. In those systems, a blending or anti-aliasing technique is employed to enhance the perceived quality of vector objects, such as lines. FIG. 1D illustrates the technique. The image 120, now 120*a*, has been transformed so that certain pixels have been blended according to the colors and distance of neighboring pixels. For instance, the pixel 125, now pixel 125*a*, has been blended so that it assumes a color midway between that of the line and that of the other neighboring pixels. In essence, the technique "fuzzes" the line so that the rendering of the line appears more accurate (i.e., less "jaggy"). The image 120*a* is not, technically speaking, as accurate an image as that of the original image 120. Nevertheless, the technique smooths out edges so that the human eye perceives a less jagged line.

This process of blending neighboring pixels is known as "convolution filtering." Basically, the technique works by applying a convolution filter to all of the pixels which lie on either side of the line. The convolution filter itself is generally a set of weightings applied to neighboring pixels (i.e., relative to the current pixel under examination). For the convolution filtering of FIG. 1D, for instance, an exemplary convolution filter would generally specify relatively smaller weightings for pixels as one moved in a direction away from the current pixel of interest. In other words, the farther away a pixel is from the current pixel of interest, the less blending it would undergo.

For real-time video, the image enhancement extracts a heavy performance toll. Applying conventional anti-aliasing methodology, for instance, the line would have to be redrawn each time the background scene (i.e., digital video) changes. Similarly, if the line were moved (i.e., to a different position on screen), the anti-aliasing image of that line would have to be recomputed. With underlying video changing potentially at a rate on the order of 30 frames per second, the computational burden of recomputing anti-aliasing calculations, without further enhancement, exceeds the capacity of all but the most-expensive hardware. In particular, the floating-point intensive calculations generally required by conventional anti-aliasing techniques tend to overwhelm microprocessors generally employed for mass-market interactive TV applications, such as set-top interactive TV devices and video games. These devices, because of price competition, generally use low-end microprocessors which are poorly suited to floating-point calculations.

When a vector image is displayed on a static background, such as a green line displayed on a black background, the computation is relatively straightforward. The system can apply a weighting which is a function of the distance a particular pixel is from the line. For vector graphics superimposed on top of digital video (e.g., real-time video), however, the task is far more complex. In particular, the system must first read every neighboring pixel of the line, to ascertain its value, before it can compute an appropriate transformed or blended color. And in systems where the digital video itself is changing at a rate of 30 frames per second or more, the task of checking each and every neighboring pixel becomes, in computational terms, prohibitively expensive. Moreover, when the image underneath is continually changing, the vector graphic must be continually redrawn to render the line with the convolution filtering appropriate for the then-current underlying image, which itself is about to change. The strain on the computational limits of graphic systems in this scenario may, therefore, be summarized as follows. First, the underlying digital video must continue to be displayed in real-time, such as 30 frames per second, so that rendering of that image is not degraded. Second, the system must acquire, on an almost instantaneous basis, the state of each and every vector graphic superimposed on top of the digital video and, further, be able to redraw each and every one of those vector graphics with the convolution filter (as now applied against a new data set).

All told, image processing of real-time video is computationally challenging, as each image represents a data set of enormous size. Moreover, when vector graphics are overlaid on top of the real-time video, using image enhancement methodology (e.g., convolution or linear filtering), several operations must be performed on each and every pixel in the image, all at real-time rates (e.g., 30 frames per seconds). What is needed is a video system with methods for rendering vector images on top of rapidly-changing digital video in a manner which preserves the advantages of filtering techniques, yet does not require the redrawing of each and every vector graphic every time the image underneath changes. The present invention fulfills this and other needs.

SUMMARY OF THE INVENTION

The present invention comprises a digital video system with improved methods for rendering vector graphics which are superimposed on top of rapidly changing background images, such as found in interactive television. Preferred video system and methods are described for improved image processing (e.g., anti-aliasing) of digital images, by performing the image processing later in the digital video processing cycle than is traditionally done.

For improving the performance and efficiency in which a video system renders digital images (particularly, vector graphics overlaid on top of real-time video), the video system of the present invention introduces a shift register component between video memory and video digital-to-analog components. In this fashion, the shift register stores, at any given time, a collection of pixel values which have been scanned (read) out of the video memory. The shift register is adapted so that a neighborhood of pixel values is available at a given instance for a current pixel from the image stored in the video memory. More particularly, selected cells of the shift register are adapted to include "taps" which form connections between those cells and the input to a multipler/adder circuit. In an exemplary embodiment, the input is buffered, such as may be done conventionally with a dual-ported collection of pixel registers. Once a given neighborhood of pixel values is supplied to the multiplier/adder circuit, the system may compute a new (i.e., enhanced) pixel value by applying a filter template—a collection of filter weightings or coefficients. This is done for each pixel in the image (or image pair) to be processed.

The present invention recognizes that since all pixels are already "running past" the video subsystem, the task of image processing (e.g., anti-aliasing) need not be performed by the CPU of the computer, with its associated overhead. Instead, the video subsystem is modified as described above to "pick off" the appropriate pixels as they are scanned out of the video memory for image processing computations. In this manner, the image processing may be performed at the video subsystem, in parallel with the scan out of pixel values from the video memory.

A preferred methodology for image processing is as follows. A filter template is stored which includes weightings for enhancing the rendering of each pixel of a digital image, based on values of neighboring pixels. For a video memory or frame buffer having a width of p pixels and a filter having n columns and m rows, the shift register has at least $(p\times(n-1)+m)$ slots or cells. At a particular clock interval, successive pixels in the video memory are shifted out in raster order into the shift register. In this manner, the shift register, at any given time, is employed to provide a neighborhood of pixel values for a particular pixel from the underlying image. In a preferred embodiment, the shift register is arranged (logically) into shift register rows: one row for each row of the filter template. In a clock-synchronized fashion, pixel values from the neighborhood are copied into pixel registers. In an exemplary embodiment, this is done by adapting those cells of the shift register rows which correspond to the filter template to each include a tap for providing its pixel value to one of the pixel registers. The pixel registers, which serve as a buffer, provide the pixel values in turn to the multiplier/adder circuit. This input is provided in conjunction with the weightings of the filter template. Based on the pixel values from the supplied pixel neighborhood and based on the weightings, the multiplier/adder circuit generates a new pixel value. The foregoing steps are repeated for all of the pixels of the underlying image for rendering an image-processed (i.e., enhanced) version of that image.

The approach is easily adapted to extend to video systems having more than one memory plane. In particular, an alternative embodiment is described which provides, using the foregoing approach, improved image processing to a dual-plane system which processes vector graphics overlaid on top of real-time video images.

DETAILED DESCRIPTION OF A PREFERRED EMBODIMENT

The following description will focus on the presently preferred embodiment of the present invention, which is operative in a graphic workstation requiring a video system capable of displaying real-time video with superimposed vector graphics. The present invention, however, is not limited to any particular application or environment. Instead, those skilled in the art will find that the present invention may be advantageously applied to any application or environment requiring real-time processing of continually varying video data. The present invention is particularly advantageous in those environments requiring the rendering of real-time video with superimposed vector graphics, including interactive television, computer games, and the like. The description of the exemplary embodiments which follows is, therefore, for the purpose of illustration and not limitation.

Graphics System

A. Graphics Workstation

Figure 1A:
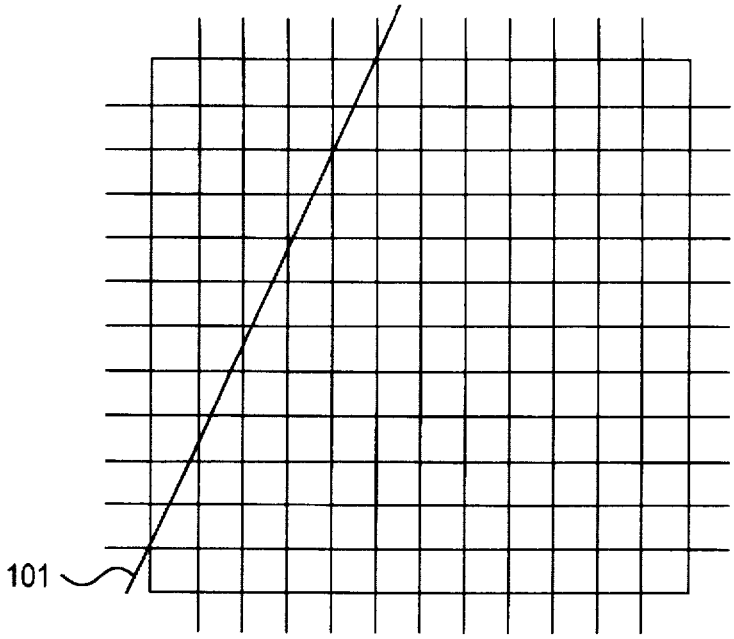
FIG. 1A (PRIOR ART)
FIGS. 1A–B are diagrams illustrating the rendering (display) of a line on a raster device, such as a display monitor.
Figure 1B:
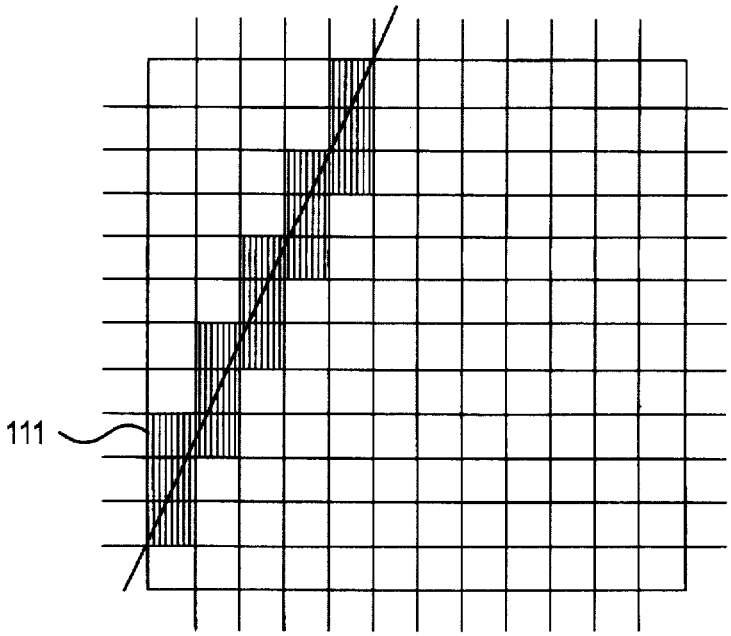
FIG. 1B (PRIOR ART)
Figure 1C:
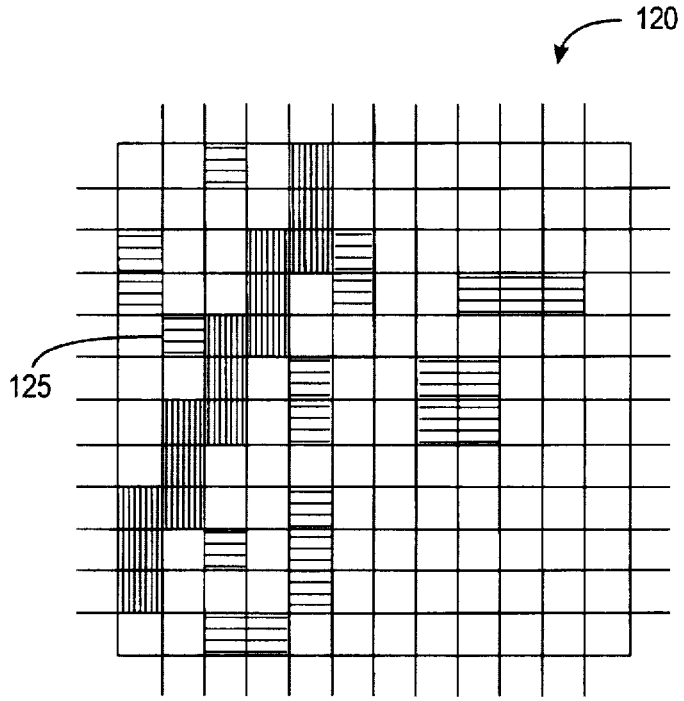
FIG. 1C (PRIOR ART)
FIG. 1C is a diagram illustrating the rendering of a line (vector object) on top of a real-time image.
Figure 1D:
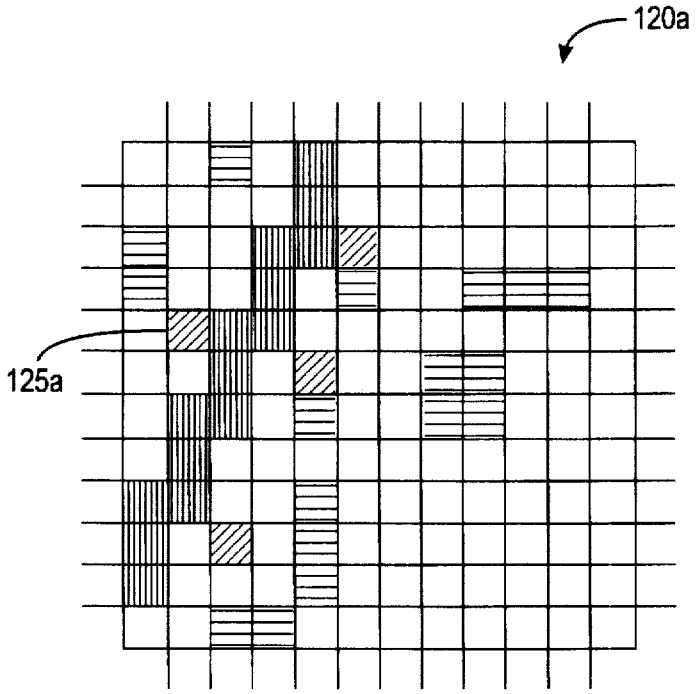
FIG. 1D (PRIOR ART)
FIG. 1D is a diagram illustrating the application of a linear or convolution filter to the line drawn in FIG. 1C, for "smoothing out" the edges of the line.
Figure 2A:
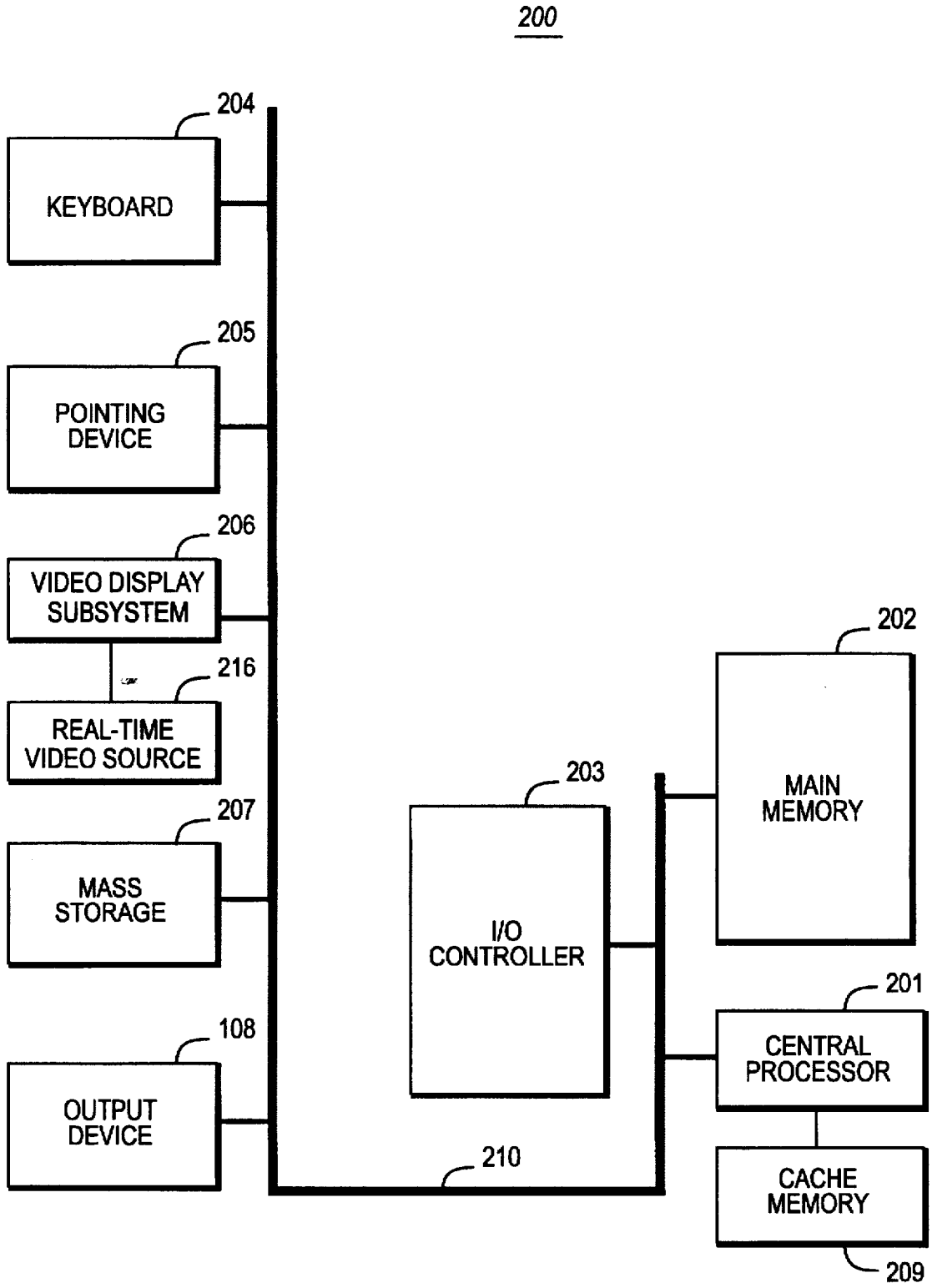
FIG. 2A is a block diagram illustrating a graphic workstation having a video display subsystem in which the present invention may be embodied.

The invention may be embodied on a graphics workstation computer system such as the system 200 of FIG. 2A, which comprises a central processor 201, a main memory 202, an input/output controller 203, a keyboard 204, a pointing device 205 (e.g., mouse, track ball, pen device, or the like), a video display subsystem 206 with real-time video feed or source 216 (e.g., digital video camera), or with real-time video decompression, and a mass storage 207 (e.g., hard or fixed disk, optical disk, magneto-optical disk, or flash memory). Processor 201 includes or is coupled to a cache memory 209 for storing frequently accessed information; memory 209 may be an on-chip cache or external cache (as shown). Additional input/output devices, such as a printing device 208, may be included in the system 200 as desired. As shown, the various components of the system 200 communicate through a system bus 210 or similar architecture. In an exemplary embodiment, the system 200 includes an IBM PC compatible personal computer, available from a variety of vendors including IBM of Armonk, N.Y.

B. System Software

Figure 2B:
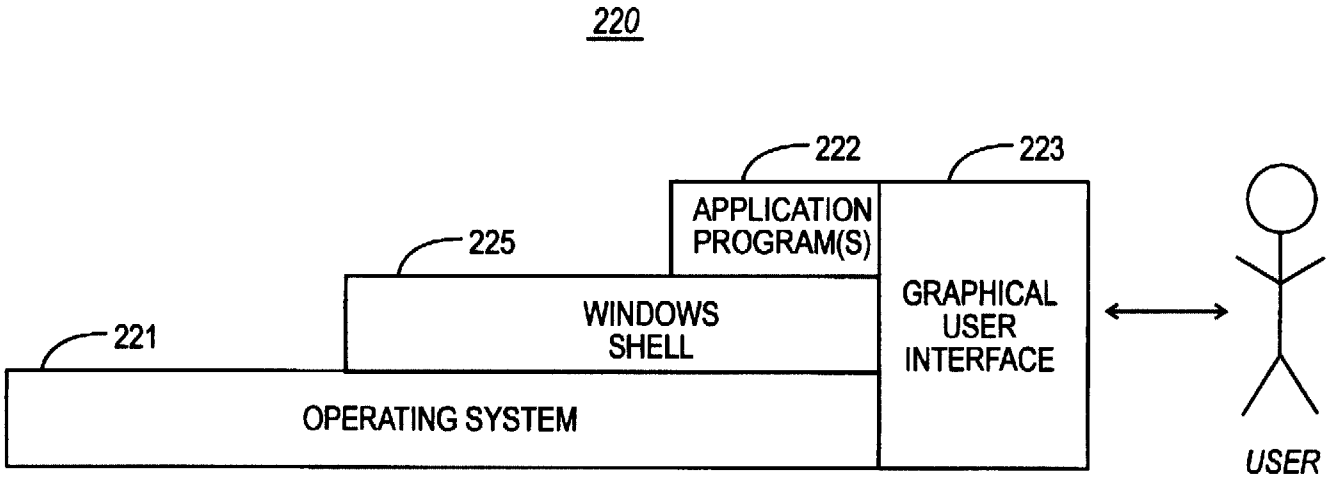
FIG. 2B is a block diagram illustrating a computer software subsystem for controlling operation of the graphic workstation of FIG. 2A.

Illustrated in FIG. 2B, a computer software system 220 is provided for programming the operation of the graphics workstation 200. Software system 220, which is stored in system memory 202 and on disk storage 207, includes a kernel or operating system 221 and a windows shell 225. One or more application programs software 222 may be "loaded" (i.e., transferred from storage 207 into memory 202) for execution by the system 200. Under the command of software 221 and/or application software 222, the system 200 receives user commands and data through a graphical user interface (GUI) 223. Application software 222 can be any one of a variety of interactive video software applications, including multimedia applications, interactive television applications, and the like. The GUI 223 also serves to display results, whereupon the user may supply additional inputs or terminate the session. Specifically, the GUI 223 is displayed by the video display subsystem 206, which is constantly updated with real-time image information and/or vector graphic image information from the system. From the images displayed, the user may perceive the results (i.e., information desired) for the task at hand. In an exemplary embodiment, operating system 221 and windows shell 225 are provided by Windows NT operating Microsoft Video for Windows. Alternatively, operating system 221 and windows shell 225 are provided by Windows 3.1, Windows for Workgroup, or Windows 95. All are available from Microsoft Corporation of Redmond, Wash.

C. Video Subsystem

Figure 2C:
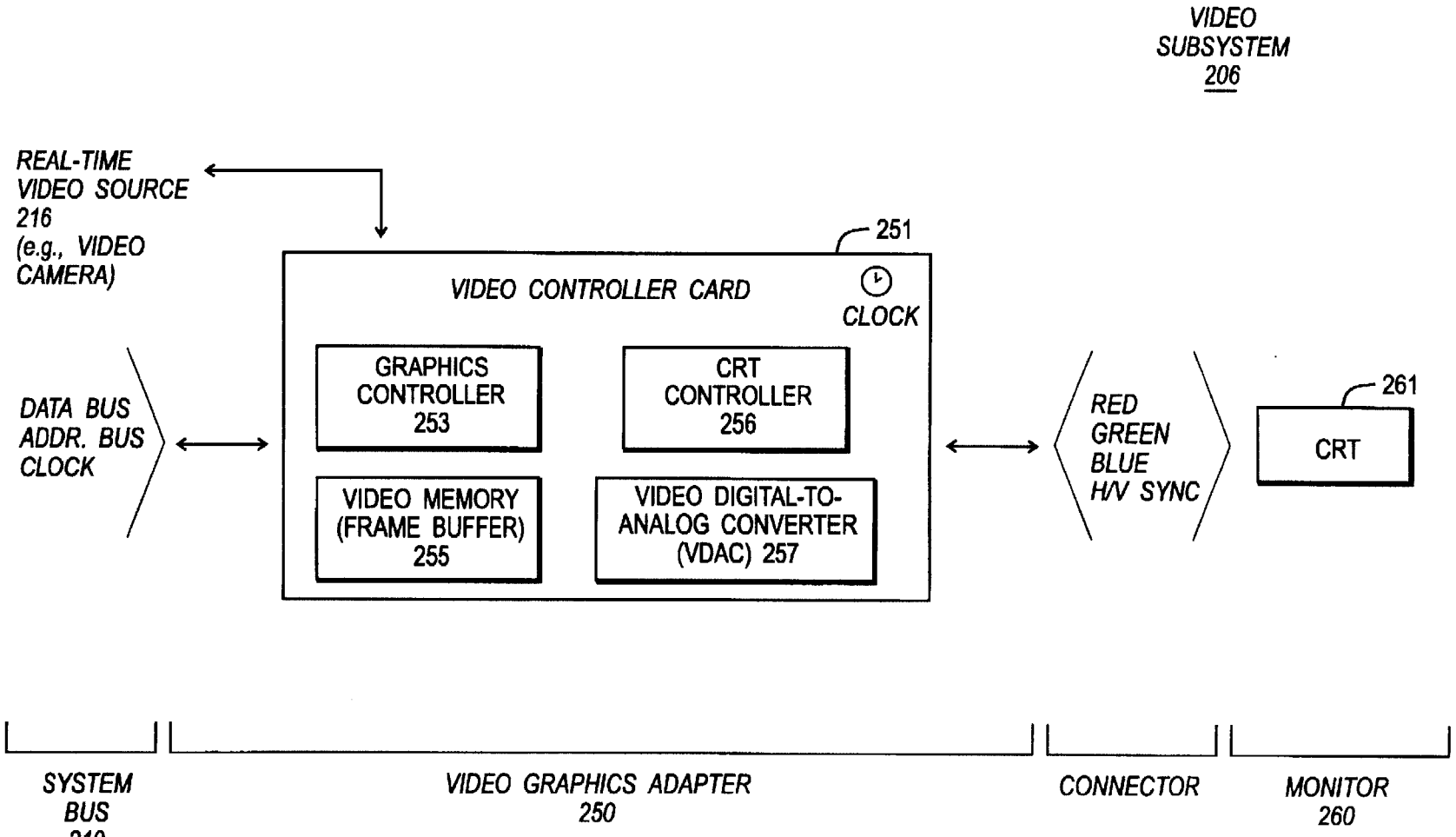
FIG. 2C is a simplified block diagram of the video subsystem of the graphic workstation of FIG. 2A.

Referring now to FIG. 2C, the video display apparatus or subsystem 206 of FIG. 2A will be described in greater detail. The video may be viewed as two separate components: a video graphics adapter 250 and a display monitor 260. In an exemplary embodiment, the graphics adapter comprises a video controller or adapter card 251 which receives address and data signals from the processor or CPU 201, via bus 210 (or via a dedicated bus). It, in turn, creates a video signal for driving the monitor 260, which comprises a cathode-ray tube (CRT) 261.

An exemplary video controller card 251 includes a graphics controller 253, a video memory 255, a CRT controller 256, and a video digital-to-analog converter (VDAC) 257. The graphics controller 253, typically implemented as a VLSI (very large scale integration) integrated circuit, resides (conceptually) in the data path between the system processor 201 and the video or display memory 255. In its default state, the graphics controller is transparent (i.e., effectively allows direct access of the video memory 255 by the processor 201). In conjunction with a coprocessor or accelerator, the graphics controller 253 may be programmed to assist in drawing operations, thereby off-loading tasks that would otherwise be performed by the main processor of the computer system.

The display or video memory 255 serves as sort of an "electronic canvas" for creating images or raster bitmaps to be displayed on the monitor 260. Essentially, writing a single bit into the display memory 255 is equivalent to lighting one pixel on the monitor screen. Two common techniques for storing color information in video memory are the packed pixel method and the color plane method. With the former, all color information for a pixel is packed into one word of memory data. With the latter, more-common approach, the display memory is logically separated into independent "color planes" of memory, with each plane comprising a region of memory for representing a single color component (e.g., red, green, or blue). Each pixel of the display corresponds to a single bit position in each color plane.

The other components of video controller 250 function as follows. The CRT controller 256 generates timing signals, such as syncing and blinking signals, to control the operation of the CRT display and display refresh timing. Overall timing of the controller card 250 is controlled by a on-board clock or sequencer. The VDAC 257 reads the display information from the video memory 255, one or more bytes at a specified time interval, and converts it into an analog video signal suitable for driving the CRT display. Although not shown, the controller card 251 generally includes other support chips, such as an attribute controller having a color lookup table for translating color information from the display memory into color information for the CRT display. A chip set suitable for constructing the controller card 250 is available from a variety of vendors, including Tseng, ATI, Chips and Technologies, Genoa, and Video Seven.

Coupled to the controller card 250, the monitor 260 converts video signals of the controller 250 into screen images. Typically, monitor 260 will be a Cathode Ray Tube (CRT) device 261, which generates an image in response to a beam of electrons striking a phosphorus coating on the back of its screen. The electron beam sweeps across the display screen from left to right in a series of horizontal lines. With conventional VGA (Video Graphics Array) and SVGA (Super Video Graphics Array) monitors, a complete frame (screen refresh) occurs on the order of about seventy times per second Monitors suitable for use as a CRT 261 are available from a variety of vendors, including NEC, Sony, IBM, and Mitsubishi. Alternative display technologies, such as LCD and LED, are suitable for use as the monitor 260.

Optimized Rendering of Vector Graphics Superimposed on Digital Video

According to the present invention, the steps taken for image processing, such as anti-aliasing and edge enhancement, are performed later in the digital video processing cycle than is traditionally done. Before describing this in detail, however, it is first helpful to examine in detail the operation of the video display subsystem. From that foundation, the teachings of the present invention may be better understood.

Figure 3A:
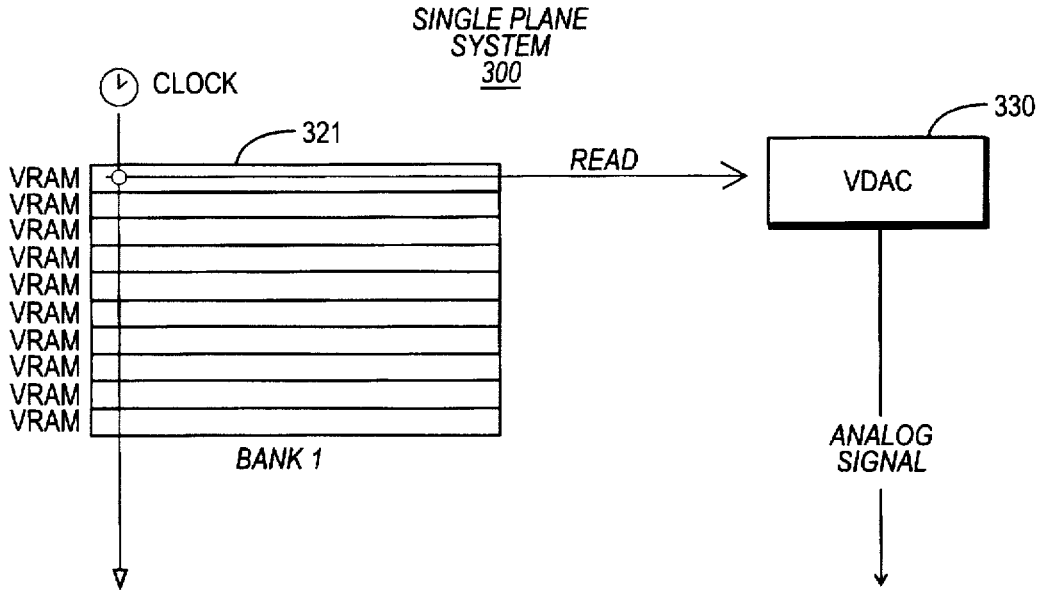
FIG. 3A is a block diagram illustrating the basic operation of a single plane video system.
Figure 3B:
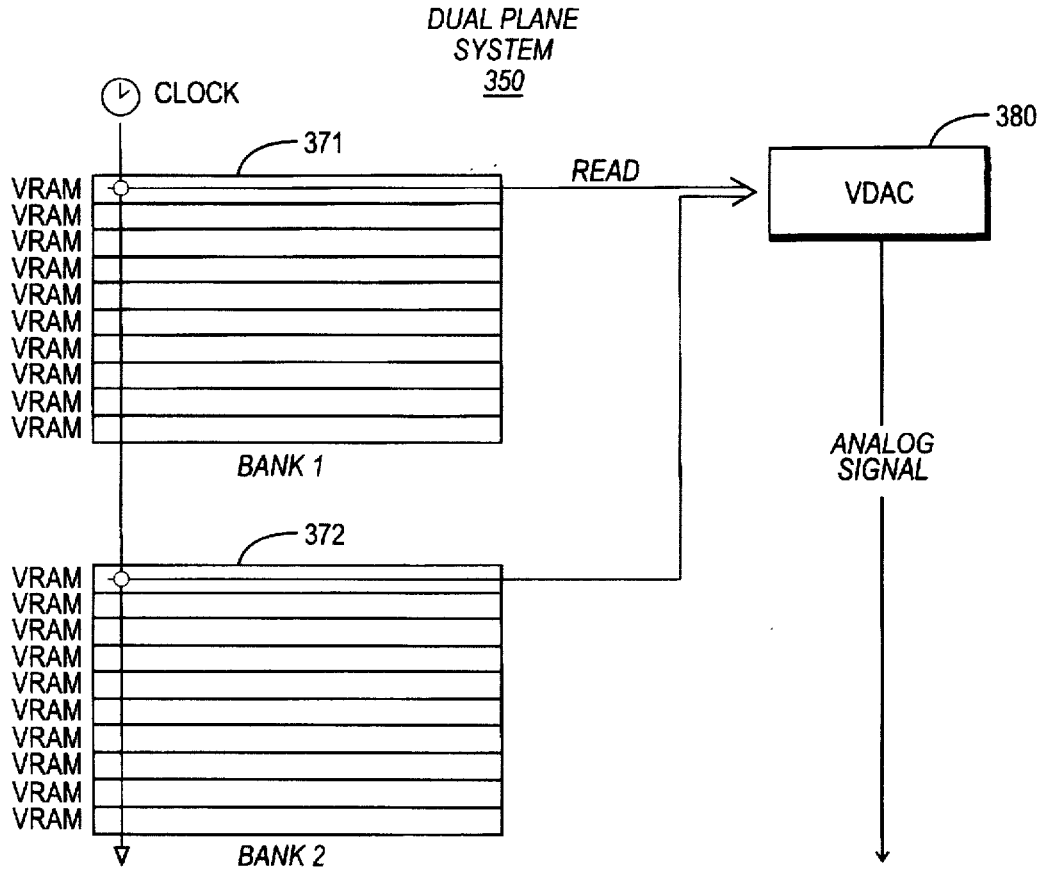
FIG. 3B is a block diagram illustrating the basic operation of a dual plane video system, which processes both vector graphics and real-time video images.

FIGS. 3A–B illustrate single-plane and dual-plane video system embodiments, which include the above-described video memory and VDAC. As shown, a single-buffered video system 300 includes a video frame buffer which may be viewed as successive rows of VRAM (video random access memory) or VRAM bank 321 A single "plane" or buffer represents a single logical plane or bank of pixels; each pixel of the plane may have one or more bits (e.g., 8 bits for 256 colors). As is known in the art, VRAM is similar to DRAM except that VRAM includes a dedicated output port. A VRAM can, thus, write itself out to another location. For rendering one video frame, the VRAM rows are scanned out: the bits stored by corresponding pairs of VRAM rows are "marched" out in lock step. In other words, the VRAM rows, operating under control of a clock, shift their bits out (i.e., place them on a data bus) at a particular frequency. This output is supplied to a video digital/analog converter (VDAC) 330. The VDAC 330, in turn, converts the bit stream information into an analog video signal (e.g., by performing a lookup and related operations). The clock or pixel rate itself is typically driven at a rate equal to the number of pixels per row (horizontal resolution) multiplied by the number of rows (vertical resolution) multiplied by the scan rate of the monitor being driven (e.g., 60 Hertz).

In a system which provides both real-time video and vector graphics, generally a dual plane system is employed. FIG. 3B illustrates a dual plane or buffer video system 350 which includes a first bank 371 (overlay bank) for rendering vector graphics and a second bank 372 for rendering real-time video. As shown, both banks simultaneously write into the VDAC 380, in a manner similar to that described above. Using a "chroma-key," the VDAC 380 selects, at any given instance, one of the two pixels coming in for display. Generally, if the pixel coming out of the overlay bank 371 is considered to be a "transparent" color by the VDAC, the corresponding pixel coming out of the video buffer 372 is displayed. If the pixel from the overlay buffer is, on the other hand, a non-transparent color, then that pixel is displayed (in lieu of the corresponding pixel from the video buffer). In operation, therefore, the VDAC 380 performs a selection of one pixel from the pair which has arrived as its input.

Note that the just-described systems suffer from the previously-described problem of jagged edges. Note further that the design results in all pixels (i.e., pixel bits) being marched out by the VDAC 380. Thus, all bits of both images are available to the VDAC, despite the fact that only one of each pair will be employed for rendering the final image. This feature will be exploited to rid the system of the problem of jagged edges.

Filtering techniques, which are very common in image processing, are employed to transform an input image into a new, enhanced version of that image. Two-dimensional filtering techniques, for instance, process small "neighborhoods" in an input image to generate new pixels in an output image. In other words, each output pixel is computed as a function of a small neighborhood of adjacent pixels from the input image.

Figure 3C:
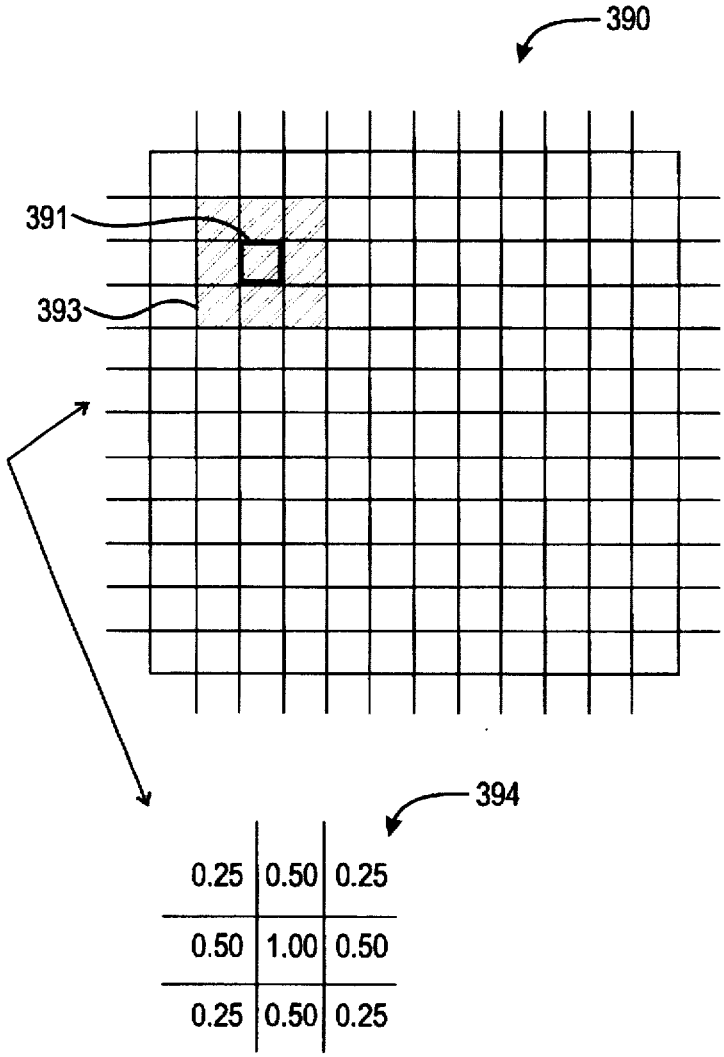
FIG. 3C is a diagram illustrating the application of a filter template to an image for achieving a desired filter effect, such as anti-aliasing.

FIG. 3C illustrates an example 3×3 filter, which employs a nine pixel (3×3) neighborhood. Specifically, FIG. 3C illustrates an image array 390 comprising an array of pixels arranged in row and column format. Each cell of the array 390, therefore, represents one pixel. Each pixel, in turn, comprises some number of bits, such as 8 bits for a 256 gray-scale monochromatic image. Each output pixel from the image array 390 depends on a different neighborhood in the original image. Pixel 391 (pixel 3,3), for instance, depends on a 3×3 neighborhood centered about that pixel and employing the weightings of the applicable filter (e.g., filter template 394). Thus for the pixel 391, the output pixel is produced by the filter window 393, which defines the 3×3 neighborhood for that pixel. Conceptually, therefore, the output image is produced by sliding the input image under a 3×3 filter window, with a corresponding output pixel being computed for each new location of the window. As a result of this approach, neighborhood-based filtering is characterized by the repeated application of identical operations.

The choice of neighborhood operation determines the ultimate appearance of the output image. A weighted sum of neighborhood pixels, for instance, can be employed to smooth (i.e., low-pass filter) or enhance (high-pass filter) output images. The image filter or "filter template" 390, therefore, defines neighborhood operations applied at every pixel in the input image. For a simple linear filter, the system applies the filter by centering it at a particular pixel of the input image, multiplying each filter pixel (which has a defined weighting) by the associated underlying image pixel, and summing the resulting products. This sum becomes the new pixel value for the corresponding pixel in the output image. Other filter types have been described in the literature. See e.g., A. Rosenfeld and A. Kak, *Digital Picture Processing,* Second Edition, Academic Press, 1982; and B. Jahne, *Digital Image Processing,* Springer-Verlag, 1991. The disclosures of each of the foregoing are hereby incorporated by reference.

Figure 3D:
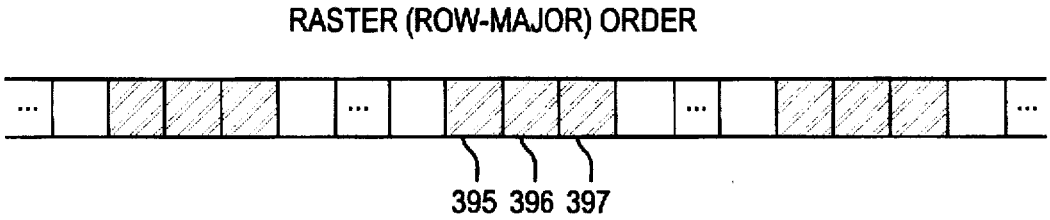
FIG. 3D is a diagram illustrating a stream of pixel values, in raster order, for some of the pixel values in the image array of FIG. 3C.

As shown in FIG. 3D, although the pixels of a neighborhood are contiguously located in the underlying physical image, they are not necessarily stored contiguously by the resulting video signal which is produced (e.g., by a video camera, or computer). Typically, a video source produces pixels in row-by-row or "raster" order. In other words, the pixels are produced serially in row-major order, beginning with the first row, followed by the second row, and so forth and so on. FIG. 3D illustrates shaded pixel groups 395, 396, 397 which represent a single 3×3 image neighborhood for a particular pixel (e.g., the pixel at position 3,3).

Figure 4A:
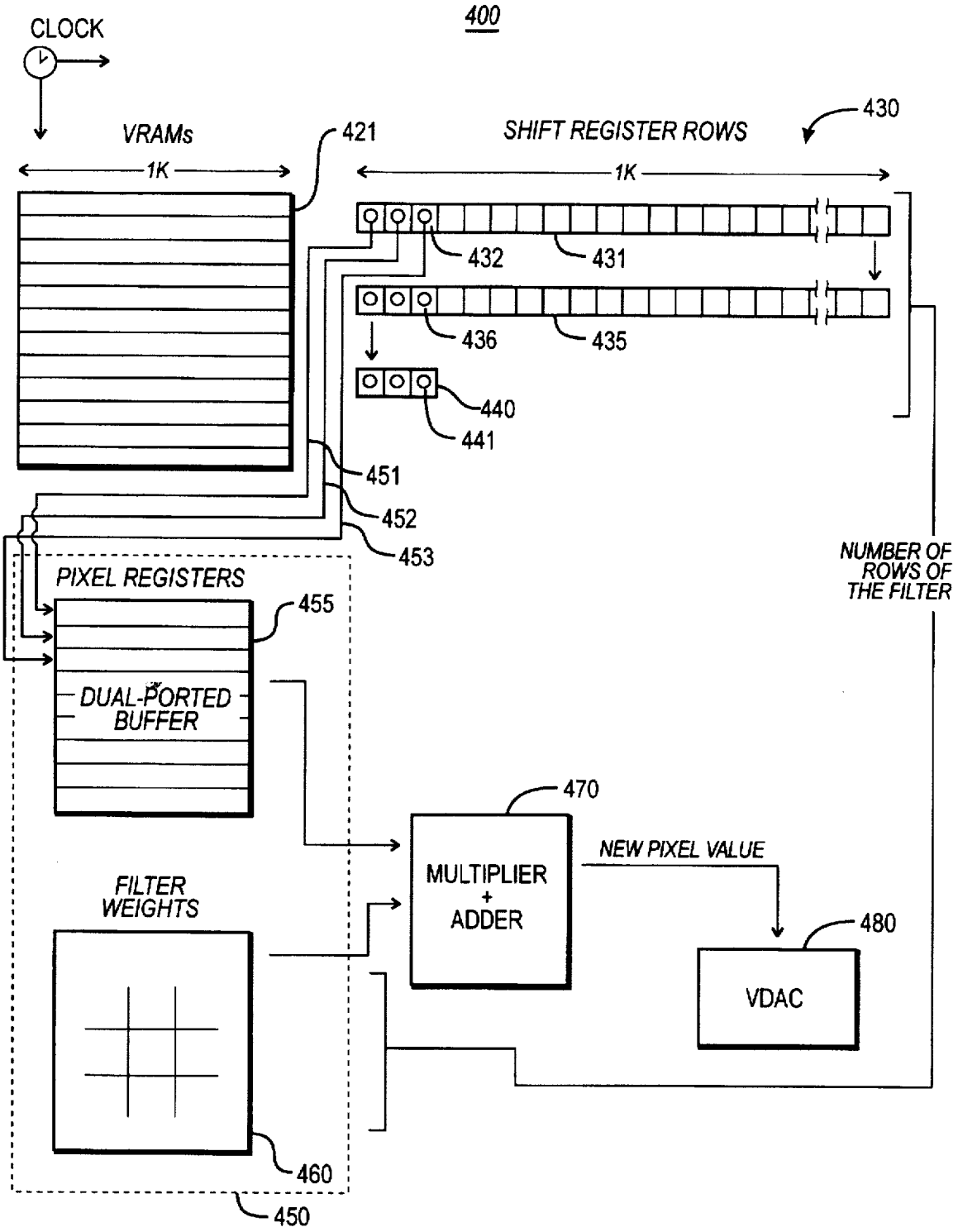
FIG. 4A is a block diagram illustrating a single plane video system of the present invention.

FIG. 4A is a block diagram illustrating a video subsystem 400 modified in accordance with the present invention. For sake of simplicity, a single plane system is illustrated. Those skilled in the art will appreciate that the modifications, in accordance with the teachings of the present invention, may be generalized to dual plane and multi-plane systems (as will be shown in FIG. 4C). Accordingly, the use of a single plane system is for the purpose of illustration and not limitation.

As shown, the video subsystem 400 includes a VRAM bank 421. As before, the VRAM bank shifts or "marches out" its bits at a particular rate, driven by a clock, for conversion to an analog video signal (which is ultimately rendered as an image on screen). The output of the bank is not fed directly into the VDAC, however. Instead, the output is supplied first to a large shift register 430, which is divided into shift register rows 431, 435, 440. All but the last row has a width matching that of the VRAM memory bank 421. If, for instance, the VRAM bank has a width of 1K (i.e., 1024) pixels, the shift register rows 431, 435 are also 1K wide. Other exemplary widths include 640 (e.g., VGA) and 800 (e.g., SVGA).

The number of rows of shift register required is a function of the number of rows of the filter to be applied for image processing. Stated generally, for a video memory or frame buffer having a width of p pixels and a filter having n columns and m rows, the shift register has at least $(p\times(n-1)+m)$ slots or cells. For a 3×3 filter (i.e., three pixels wide and three pixels high), such as image filter (weights) 460, three shift register rows are required, such as register rows 431, 435, 440. Typically, a 3×3 filter is applied. Other filters include 5×5, 9×9, and the like. In those instances, the rows of the shift register would be increased (e.g., five rows, nine rows, and the like) accordingly. In an exemplary embodiment for real-time video applications, a 3×3 filter achieves satisfactory results, as any particular frame generally has a life of only 1/30 second.

The shift register is responsive to a clock signal for driving its shifting operation. For this purpose, the same clock which drives the VRAM bank 421 may be employed. In this fashion, the shifting of bits in the shift registers occurs in lock step with the shifting or scanning out of pixel bits from the VRAM bank 421.

Figure 4B:
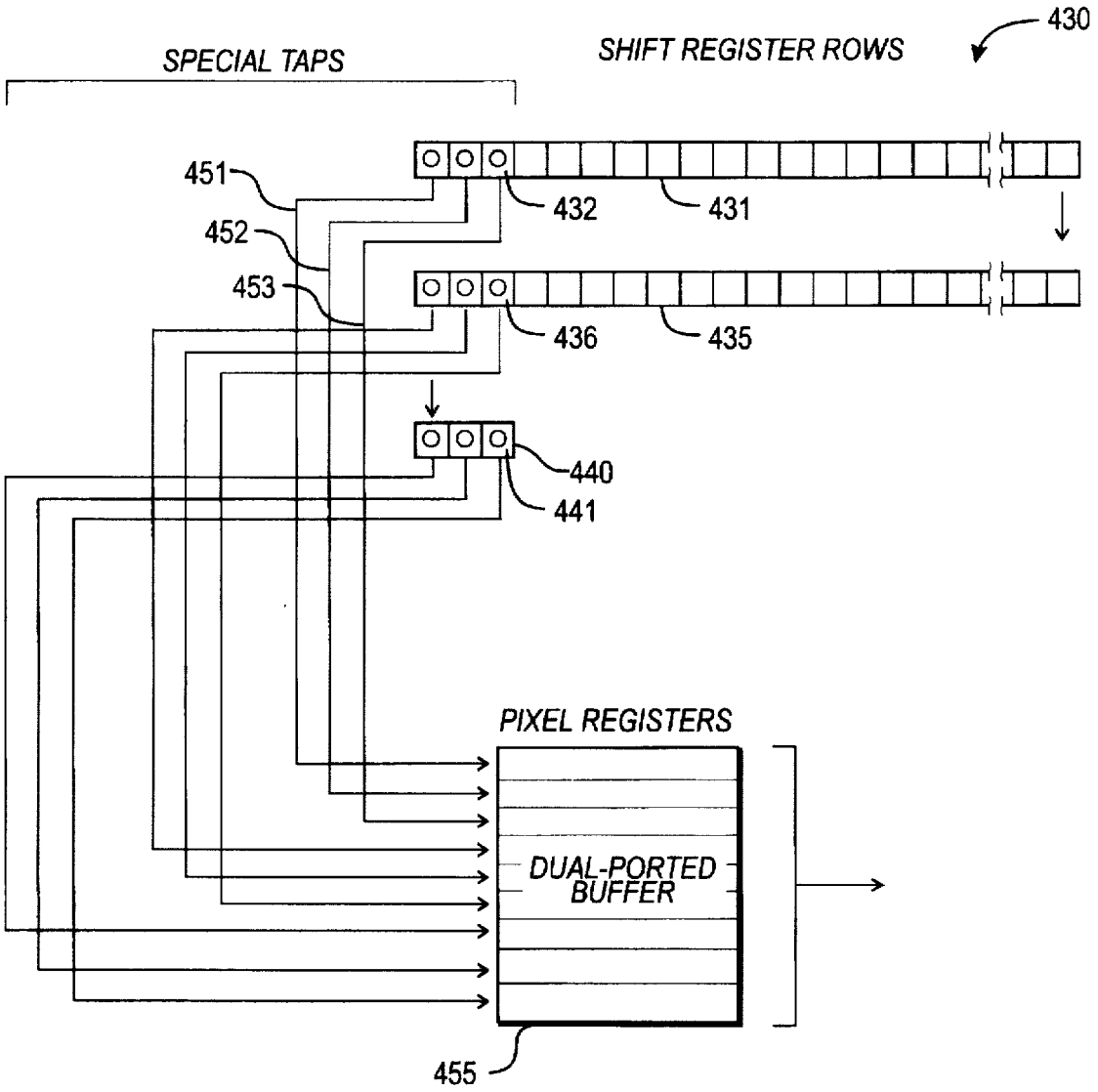
FIG. 4B is a block diagram illustrating shift register rows of the video system of FIG. 4A, the shift register rows including special "tap cells" for providing output of a neighborhood of pixel values.

The first n number of bit cells in each shift register row include special "tap cells" 432, 436, 441 for supplying their respective bit values to pixel registers; here, n is equal to the width of the filter (e.g., three). The taps cells may be implemented in a conventional manner, using VLSI or discrete components. The orientation of the tap cells of the shift register rows is shown in further detail in FIG. 4B. This corresponds to the orientation of the image filter being applied to the VRAM image. For example, the pixel value at 436 is aligned with its actual neighbors in VRAM memory and on screen (i.e., vertical neighbors 432, 441). This relative orientation is desired since it simplifies the task of applying the filter. As shown, the taps, such as taps 451, 452, 453, supply respective inputs to a buffered-input, such as dual-ported pixel registers 455. These are later combined with the filter weights 460 (e.g., anti-aliasing coefficients), which are generally statically loaded at system startup (e.g., from a read-only memory or ROM). Collectively, pixel registers 455 and filter weights 460 form an image processing (e.g., anti-alias) circuitry 450. The pixel bits stored in the pixel registers 455 and the coefficients stored in the filter weights 460 are supplied to a conventional multiplier and adder circuit 470, which multiplies each pixel by its appropriate weight in parallel and add those values together (e.g., in a nine-way adder). This generates a new pixel value which is supplied to the VDAC, shown at 480. In instances where integral weights are employed, however, an additional multiplier (i.e., multiplier coefficient) is added before the VDAC. Finally, the VDAC supplies an appropriate analog video signal for driving a monitor.

The present invention recognizes that since all pixels are already "running past" the video subsystem, the task of image processing (e.g., anti-aliasing) need not be performed by the CPU, with its associated overhead. Since the pixels are running past the video subsystem at an appropriate time (i.e., clock synchronized), the video subsystem may be modified to "pick off" the appropriate pixels for anti-aliasing or other image processing computations, as those pixels pass through. Specifically, pixels are picked off the shift register rows, as pixel values are marched out the VRAM and through the shift register. Preferably, the components of the video subsystem 400 are clocked at some integral pixel time, so that the VDAC 480 is fed pixels at an appropriate rate (i.e., the rate necessary for driving the scan frequency of the monitor). The glue logic necessary for achieving such timing may be implemented in a conventional manner.

Note particularly that in prior art systems performing the image processing task, such as anti-aliasing, at the CPU is particularly slow. Not only must the CPU read every pixel and then write it back, but that process must also occur over a relatively-slow bus (e.g., system bus). To perform anti-aliasing at the CPU in real-time, the CPU needs to read all of the pixels from the frame buffer, perform all of the anti-aliasing calculations, and write the new values back to the frame buffer, all within the time span of one frame (e.g., 1/30 second). Although a graphics coprocessor may be employed at the video subsystem for decreasing bus I/O (input/output) and CPU burden, time-consuming calculations are still performed using a specialized (and relatively expensive) microprocessor.

In the system of the present invention, in contrast, the image processing of the pixel values occurs at the video display subsystem, using relatively inexpensive components. As the processing of the pixel values occurs between the frame buffers (VRAM banks) and the VDAC, the approach of the present invention has the added advantage that the frame buffers themselves are left unaltered. In this manner, application programs and graphic accelerators can read and write to the frame buffers as before.

Although the above-described single plane version does not accommodate real-time video by itself, it nevertheless provides useful video enhancement. The filter, for example, may be set up with coefficients for edge enhancement (as opposed to the previously-described weightings for anti-aliasing or edge blurring). Those skilled in the art will appreciate that other image processing filters may be similarly applied to advantage.

Figure 4C:
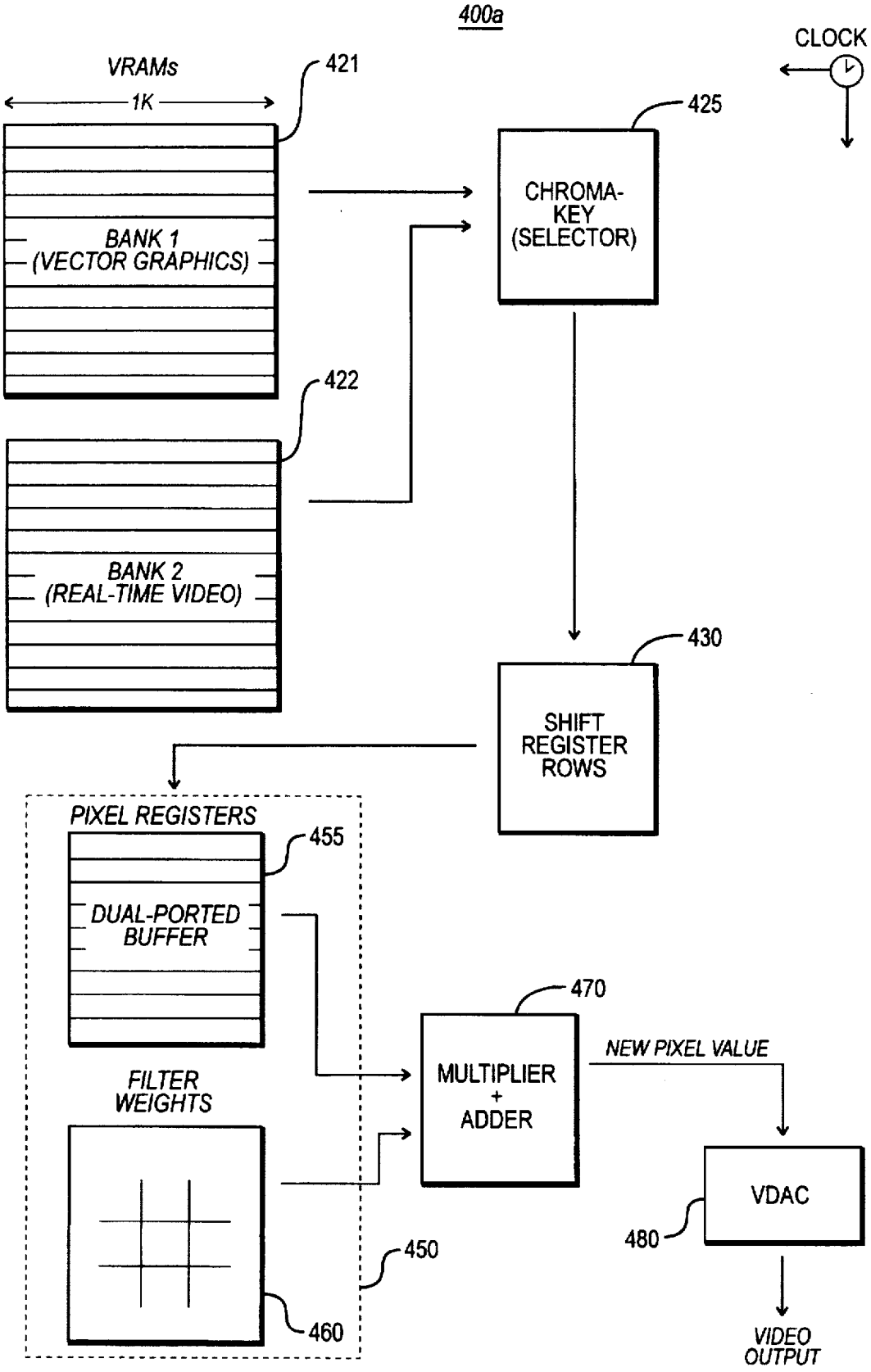
FIG. 4C is a block diagram illustrating a dual bank video system of the present invention, which processes vector graphics overlaid on top of real-time video images.

To accommodate a real-time video input, the single bank version is further modified as shown in FIG. 4C. Here, the video system is modified in a manner similar to that shown for the dual-plane system 350 of FIG. 3B. Specifically, the video system includes dual memory banks: Bank 1 (421) and Bank 2 (422). The former stores vector graphics; the latter stores real-time video images (frames). The banks are scanned to provide a raster stream of pixel values to a chroma-key or selector 425, which operates in the manner previously described (for system 350 in FIG. 3B). The chroma-key, in turn, selects a single pixel value as input to the shift register rows 430. Once the pixel value has been provided to the shift register, the system **400*a* operates in a manner essentially the same as that for system 400. With the foregoing modification, the system 400*a*** provides real-time image processing on vector graphics overlaid on top of the real-time video image.

While the invention is described in some detail with specific reference to a single preferred embodiment and certain alternatives, there is no intent to limit the invention to that particular embodiment or those specific alternatives. Those skilled in the art will appreciate that other video systems may be modified in accordance with the present invention. Thus, the true scope of the present invention is not limited to any one of the foregoing exemplary embodiments but is instead defined by the appended claims.

What is claimed is:

1. In a video system for processing digital images, said system including a memory bank having a number of rows, each row of said memory bank storing in cells a number of pixels for a digital image, a method for rendering in real time an enhanced version of said digital image, the method comprising:

(a) storing a filter template for enhancing rendering of each pixel of said digital image based on values of neighboring pixels, said filter template being divided into a number of rows, each row of the filter template having a number of cells for storing pixel weightings;

(b) at a pre-selected clock interval, shifting out in raster order successive pixels stored in said memory bank into a shift register, said shift register being divided into a number of logical shift register rows, the number of logical shift register rows being equal to or greater than the number of rows of said filter template, said logical shift register rows being divided into a number of cells, the number of cells of some of said logical shift register rows being equal to or greater than the number of cells stored in one of said rows of said memory bank, so that neighboring pixels of a particular pixel are stored logically together in said logical shift register rows;

(c) at said pre-selected clock interval, copying pixel values from a number of initial cells from each of said logical shift register rows to a number of pixel registers, said number of initial cells copied from each of said logical shift register rows being equal to or greater than the number of cells in each row of said filter template;

(d) at said pre-selected clock interval, generating a new pixel value by applying said pixel weightings of said filter template to corresponding pixel values copied to said pixel registers; and (e) rendering in real time as said digital image is being outputted for display on a display device an enhanced version of said digital image by repeating steps (b)–(d) for all pixels of said digital image.

2. The method of claim 1, wherein step (a) includes:

storing a pixel filter template having a pre-selected number of rows and a pre-selected number of columns of pixel weightings for enhancing rendering of each pixel of said digital image based on values of neighboring pixels.

3. The method of claim 2, wherein said pre-selected number of rows and said pre-selected number of columns both equal three.

4. The method of claim 2, wherein said pre-selected number of rows and said pre-selected number of columns both equal five.

5. The method of claim 2, wherein said pre-selected number of rows and said pre-selected number of columns both equal nine.

6. The method of claim 1, wherein step (a) includes:

storing a filter template for enhancing rendering of each pixel of said digital image based on values of neighboring pixels, said filter template being divided into three rows, each row of the filter template having three cells for storing pixel weightings.

7. The method of claim 1, wherein said memory bank stores at least 640 number of cells and wherein some of said logical shift register rows comprises at least 640 number of cells.

8. The method of claim 7, wherein one of said logical shift register rows comprises a number of cells equal to the number of rows of the filter template.

9. The method of claim 1, wherein said step (d) comprises:

at said pre-selected clock interval, generating a new pixel value by multiplying said pixel weightings of said filter template by corresponding pixel values copied to said pixel registers and summing resulting products for generating said new pixel value.

10. The method of claim 1, wherein said filter template provides a high-pass filter.

11. The method of claim 1, wherein said filter template provides a low-pass filter.

12. The method of claim 1, further comprising:

(f) storing a new digital image in said memory bank; and (g) repeating steps (b)–(e) for said new digital image.

13. The method of claim 12, further comprising:

(h) repeating steps (f)–(g) for a plurality of digital images at a rate selected so that a plurality of enhanced digital images are provided for display by the system in real-time.

14. The method of claim 13, wherein step (h) includes:

repeating steps (f)–(g) at a rate equal to or greater than 30 times per second, so that a plurality of enhanced digital images are provided for display by the system at a rate equal to or greater than 30 images per second.

15. The method of claim 13, wherein said pre-selected clock interval is selected to achieve a pixel rate at least as fast as the rate at which enhanced digital images are provided for display by the system multiplied by the number of rows of said memory bank multiplied by the number of pixels stored by each row.

16. The method of claim 1, further comprising:

(f) providing to a video digital-to-analog converter a new pixel value for each pixel of said digital image;

(g) generating by said video digital-to-analog converter an analog video signal based on said new pixel value for each pixel of said digital image; and (h) providing said analog video signal to a display monitor for displaying said enhanced version of said digital image.

17. A video system having an image processing unit which operates in real time as an image is being outputted for display, said video system comprising:

a video memory for storing a digital image as a sequence of pixel in raster order, said video memory comprising at least one row of memory cells storing pixels describing a digital image;

an image filter for filtering said digital image, said image filter storing at least one row of pixel weightings specifying a new output pixel value for data comprising an input pixel value and corresponding neighboring pixel values;

a clock providing a clock tick at a specified time interval;

a shift register, operably coupled to said video memory, for receiving with each clock tick a single pixel from said video memory, so that said shift register stores a sequence of pixels from said video memory in raster order, the shift register being divided into a number of rows equal to or greater than the number of rows of pixel weightings in said image filter, at least some of the rows of the shift register having a number of cells equal to or greater than the number of memory cells of a row of video memory, at least some of said cells of said rows of the shift register being tap cells, said tap cells of said rows being equal to or greater than the number of rows of pixel weightings in said image filter, said tap cells being adapted to provide from said shift register at each clock tick data comprising an input pixel value and corresponding neighboring pixel values for a particular pixel; and means, operably coupled to said image filter and to said shift register, for computing at each clock tick a new output pixel value for said particular pixel, said new pixel value being determined from said input pixel value and corresponding neighboring pixel values provided by said tap cells for said particular pixel and from said pixel weightings stored by said image filter, said means operating in real time as said digital image is being outputted for display on a display device.

18. The system of claim 17, further comprising:

a video digital-to-analog converter for converting new output pixel values into an analog video signal for displaying an image-processed version of said digital image on a display monitor.

19. The system of claim 17, wherein said video memory comprises rows of video random-access memory (VRAM).

20. The system of claim 19, wherein each row of VRAM holds 1024 memory cells, and wherein some of the rows of the shift register hold 1024 shift register cells.

21. The system of claim 17, wherein each pixel stores at least one bit defining a monochromatic picture element.

22. The system of claim 17, wherein each pixel stores a plurality of bits defining a color picture element.

23. The system of claim 17, wherein said specified time interval is selected to achieve a pixel rate at least as fast as the rate at which image-processed digital images are provided for display by the system multiplied by the number of rows of said video memory multiplied by the number of pixels stored by each row.

24. The system of claim 17, wherein said means for computing at each clock tick a new output pixel value comprises:

a multiplier/adder circuit for multiplying each pixel weighting stored by said image filter by a corresponding neighboring pixel value and summing together all resulting products.

25. The system of claim 17, wherein said image filter comprises a three-row by three-column array of pixel weightings.

26. The system of claim 25, wherein said shift register is divided into three rows.

27. The system of claim 26, wherein each shift register includes as tap cells its first three cells.

28. The system of claim 26, wherein the third row of said three shift register rows comprises only three cells, all of which are tap cells.

29. The system of claim 17, further comprising:

a plurality of pixel registers for storing said input pixel value and corresponding neighboring pixel values provided for a particular pixel by said tap cells at each clock tick, each pixel register being connected to a single one of said tap cells.

30. The system of claim 17, wherein said image filter defines an anti-aliasing filter.

31. The system of claim 17, wherein said image filter defines an edge-enhancement filter.

32. A video system for rendering a vector graphic superimposed on top of real-time digital video comprising:

a first video memory for storing a digital image as a sequence of pixel in raster order, said first video memory comprising at least one row of memory cells storing pixels describing said vector graphic;

a second video memory for storing a digital image as a sequence of pixel in raster order, said second video memory comprising at least one row of memory cells storing pixels describing one frame of said real-time digital video;

an image filter for enhancing display of said vector graphic on top of said digital video, said image filter storing at least one row of pixel weightings specifying a new output pixel value for data comprising an input pixel value and corresponding neighboring pixel values;

a clock providing a clock tick at a specified time interval;

a selector, operably coupled to said first and second video memories, for selecting with each clock tick a single pixel from said first and second video memories, said single pixel being selected based on a color-based comparison of corresponding pixels from said first and second video memories;

a shift register, operably coupled to said selector, for receiving with each clock tick said single pixel from said selector, so that said shift register stores a sequence of pixels from said video memories in raster order, the shift register being divided into a number of rows equal to or greater than the number of rows of pixel weightings in said image filter, at least some of the rows of the shift register having a number of cells equal to or greater than the number of memory cells of a row of video memory, at least some of said cells of said rows of the shift register being tap cells, said tap cells of said rows being equal to or greater than the number of rows of pixel weightings in said image filter, said tap cells being adapted to provide from said shift register at each clock tick data comprising an input pixel value and corresponding neighboring pixel values for a particular pixel; and means, operably coupled to said image filter and to said shift register, for computing at each clock tick a new output pixel value for said particular pixel, said new pixel value being determined from said input pixel value and corresponding neighboring pixel values provided by said tap cells for said particular pixel and from said pixel weightings stored by said image filter, said means operating while said real-time digital video is being outputted for display on a display device.

33. The system of claim 32, further comprising:

a video digital-to-analog converter for converting new output pixel values into an analog video signal for displaying an image-processed version of said digital image on a display monitor.

34. The system of claim 32, wherein said video memory comprises rows of video random-access memory (VRAM).

35. The system of claim 34, wherein each row of VRAM holds 1024 memory cells, and wherein some of the rows of the shift register hold 1024 shift register cells.

36. The system of claim 32, wherein each pixel stores at least one bit defining a monochromatic picture element.

37. The system of claim 32, wherein each pixel stores a plurality of bits defining a color picture element.

38. The system of claim 32, wherein said specified time interval is selected to achieve a pixel rate at least as fast as the rate at which image-processed digital images are provided for display by the system multiplied by the number of rows of said video memory multiplied by the number of pixels stored by each row.

39. The system of claim 32, wherein said means for computing at each clock tick a new output pixel value comprises:

a multiplier/adder circuit for multiplying each pixel weighting stored by said image filter by a corresponding neighboring pixel value and summing together all resulting products.

40. The system of claim 32, wherein said image filter comprises a three-row by three-column array of pixel weightings.

41. The system of claim 40, wherein said shift register is divided into three rows.

42. The system of claim 41, wherein each shift register includes as tap cells its first three cells.

43. The system of claim 41, wherein the third row of said three shift register rows comprises only three cells, all of which are tap cells.

44. The system of claim 32, further comprising:

a plurality of pixel registers for storing said input pixel value and corresponding neighboring pixel values provided for a particular pixel by said tap cells at each clock tick, each pixel register being connected to a single one of said tap cells.

* * * * *